US011236511B2

(12) United States Patent
Henderson et al.

(10) Patent No.: US 11,236,511 B2
(45) Date of Patent: Feb. 1, 2022

(54) GUARD RAIL SYSTEM AND COMPONENTS

(71) Applicant: Buildergear Corporation, Sarnia (CA)

(72) Inventors: Scott Henderson, Sarnia (CA); Derek Dochstader, Sarnia (CA); Joseph Di Biase, Kleinburg (CA)

(73) Assignee: Buildergear Corporation, Sarnia (CA)

( * ) Notice: Subject to any disclaimer, the term of this patent is extended or adjusted under 35 U.S.C. 154(b) by 0 days.

(21) Appl. No.: 16/661,279

(22) Filed: Oct. 23, 2019

(65) Prior Publication Data

US 2020/0157839 A1 May 21, 2020

Related U.S. Application Data

(63) Continuation of application No. 29/688,666, filed on Apr. 23, 2019, now Pat. No. Des. 917,077.

(51) Int. Cl.

| | |
|---|---|
| ***E04F 11/18*** | (2006.01) |
| ***E04H 17/20*** | (2006.01) |
| ***E04G 21/32*** | (2006.01) |

(52) U.S. Cl.

CPC ..... *E04F 11/181* (2013.01); *E04G 21/3223* (2013.01); *E04H 17/20* (2013.01)

(58) Field of Classification Search

CPC .... E04F 11/181; E04F 11/1865; E04H 17/20; E04G 21/3223; Y10S 256/06; E04B 1/34305; E04B 1/34389; E04B 1/3431

USPC ..... 52/832; 256/59, 67, 68, 65.02, 65.03, 256/65.14

See application file for complete search history.

(56) References Cited

U.S. PATENT DOCUMENTS

| | | | | |
|---|---|---|---|---|
| 3,480,257 | A | 11/1969 | Bourn et al. | |
| 3,863,900 | A * | 2/1975 | Dagiel | E04G 21/3242 256/59 |
| 3,880,405 | A * | 4/1975 | Brueske | E04G 21/3295 256/59 |
| 4,255,913 | A | 3/1981 | Poma | |
| 4,666,131 | A * | 5/1987 | Kettelkamp, Sr. | E04G 21/3214 256/59 |
| 4,830,341 | A * | 5/1989 | Arteau | E04G 7/28 256/59 |
| 5,145,153 | A * | 9/1992 | Glynn | E04G 21/3233 256/59 |
| 5,314,167 | A | 5/1994 | Holloman | |
| 5,456,451 | A | 10/1995 | Eyler, Jr. | |
| 5,683,074 | A | 11/1997 | Purvis et al. | |

(Continued)

FOREIGN PATENT DOCUMENTS

| | | |
|---|---|---|
| EP | 1209304 A2 | 5/2002 |
| EP | 1564345 A2 | 8/2005 |

(Continued)

*Primary Examiner* — Brent W Herring

(74) *Attorney, Agent, or Firm* — Banner & Witcoff, Ltd.

(57) ABSTRACT

A guard rail system is provided. The guard rail system includes posts and rails. The posts include a base, a body and a plurality of rail supports. In one embodiment, a stacking fin extends from the base for fitting into an opening defined in a top portion of a corresponding post that is in an upside down orientation to allow two posts to be stacked together. In another embodiment, body and rail supports are integrally formed from the same material. In another embodiment, openings are defined in the body to act as rail supports.

20 Claims, 10 Drawing Sheets

(56) References Cited

U.S. PATENT DOCUMENTS 5,718,305 A * 2/1998 Palmer ..... E04G 21/3214 182/45
6,053,281 A * 4/2000 Murray ..... E04G 21/3223 182/113
6,220,577 B1 * 4/2001 Ostrow ..... E04G 21/3204 256/65.14
6,279,880 B1 8/2001 Hawks, Jr.
6,336,623 B1 1/2002 McCarthy
6,517,280 B2 * 2/2003 Carter ..... E01F 13/02 256/13.1
6,758,448 B1 * 7/2004 Williams ..... A47B 96/02 248/125.1
7,377,491 B2 * 5/2008 Fuoco ..... E04F 11/1812 256/65.01
7,731,160 B2 * 6/2010 Terrels ..... E04F 11/1836 256/65.06
7,802,773 B2 * 9/2010 Murphy ..... E04G 21/3223 256/65.14
8,132,792 B2 3/2012 Perris
8,424,851 B2 * 4/2013 Christoffer ..... E04G 21/3223 256/65.14
9,920,540 B2 * 3/2018 Kurtz ..... E04G 3/20
10,006,222 B2 * 6/2018 Herman ..... E04H 17/20
2003/0007832 A1 * 1/2003 Carter ..... E01F 13/028 404/6
2004/0041141 A1 3/2004 Cannon
2004/0245516 A1 * 12/2004 Fuoco ..... E04G 1/38 256/65.14
2005/0098772 A1 * 5/2005 Fuoco ..... E04G 21/3223 256/65.14
2007/0246299 A1 10/2007 Wright et al.
2009/0114895 A1 * 5/2009 Terrels ..... E04F 11/1814 256/65.03
2009/0159865 A1 * 6/2009 Carvalho ..... E04G 21/3223 256/65.14
2010/0171085 A1 * 7/2010 Webster, IV ..... E01F 15/0461 256/65.14
2011/0017968 A1 * 1/2011 Christoffer ..... E01F 13/022 256/65.14
2011/0272659 A1 11/2011 Gutierrez
2011/0278526 A1 11/2011 Carvalho et al.

FOREIGN PATENT DOCUMENTS

EP 1830018 A1 9/2007
EP 2243899 A2 10/2010
GB 2398340 A 8/2004

* cited by examiner

GUARD RAIL SYSTEM AND COMPONENTS

CROSS REFERENCE TO RELATED APPLICATIONS

This application claims priority to Canadian Application No. 184271, filed Oct. 23, 2018, the entire content of which is incorporated herein by reference in its entirety.

FIELD

This specification relates to guard rail systems and components and in particular to temporary reusable guard rail systems and components for construction sites.

BACKGROUND

The following background discussion is not an admission that anything discussed below is citable as prior art or common general knowledge. The documents listed below are incorporated herein in their entirety by this reference to them.

Temporary guard rail systems are well known for use at construction sites. Such systems typically include a combination of posts and rails that may be temporarily erected to guard dangerous areas.

A problem with current temporary guard rail systems is that the systems, and in particular the posts, cannot be stored or transported in a compact and cost-efficient manner. Furthermore, many of the systems are costly to manufacture and have components that are not sufficiently durable to allow the systems to be used multiple times. Also, many of the systems do not conform to local safety standards or are not adapted for different applications such as flat surfaces, stair rail, handrail and offsets from walls for drywall installations.

There is a need for guard rail systems and components to overcome one or more of the problems identified above.

SUMMARY

In one aspect the invention provides a post for a guard rail system, said post comprising:
a base, for securing to a surface;
a body extending from said base;
a plurality of rail supports adapted for supporting rails; and
at least one stacking opening defined in said body for stacking a corresponding second post in an upside down orientation.

In another aspect, the invention provides a post for a guard rail system, said post comprising:
a base, for securing to a surface;
a body extending from said base; and
a plurality of rail supports adapted for supporting rails;
wherein said body and said rail supports are integrally formed from a single piece of material.

In another aspect, the invention provides a guard rail system, said system comprising at least two posts, each said post having:
a base, for securing to a surface;
a body extending from said base; and
a plurality of rail supports adapted for supporting rails between said at least two posts; and
at least one stacking opening defined in said body of each of said at least two posts for stacking a corresponding second post in an upside down orientation. Other aspects and features of the teachings disclosed herein will become apparent, to those ordinarily skilled in the art, upon review of the following description of the specific examples of the specification.

DRAWINGS

The drawings included herewith are for illustrating various examples of articles, methods, and apparatuses of the present specification and are not intended to limit the scope of what is taught in any way. For simplicity and clarity of illustration, where considered appropriate, reference numerals may be repeated among the drawings to indicate corresponding or analogous elements.

DESCRIPTION OF VARIOUS EMBODIMENTS

Various apparatuses or methods will be described below to provide examples of the claimed invention. The claimed invention is not limited to apparatuses or methods having all of the features of any one apparatus or method described below or to features common to multiple or all of the apparatuses described below. The claimed invention may reside in a combination or sub-combination of the apparatus elements or method steps described below. It is possible that an apparatus or method described below is not an example of the claimed invention. The applicant(s), inventor(s) and/or owner(s) reserve all rights in any invention disclosed in an apparatus or method described below that is not claimed in this document and do not abandon, disclaim or dedicate to the public any such invention by its disclosure in this document.

Figure 1:
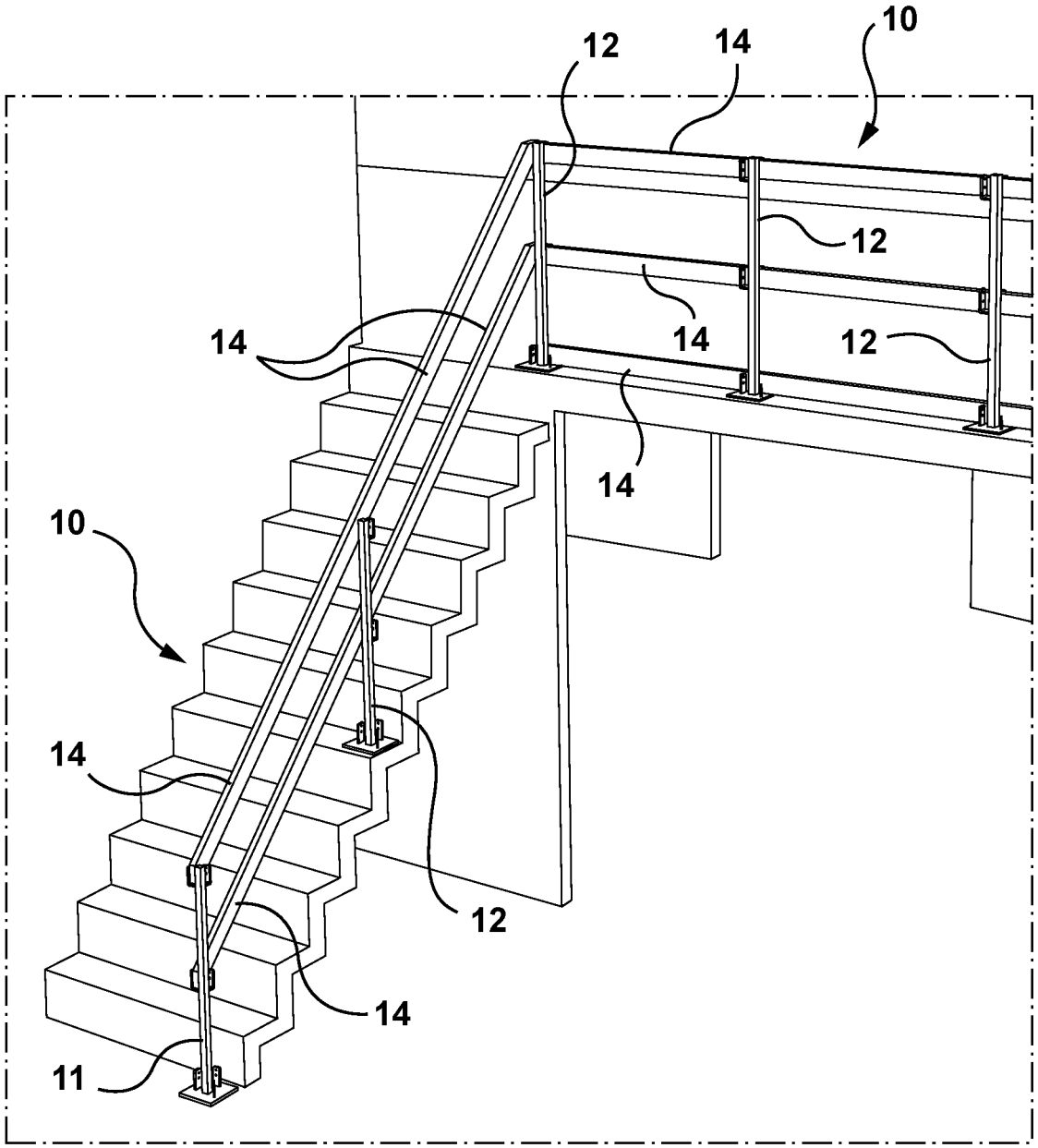
FIG. 1 is a schematic view of a guard rail system in accordance with one aspect of the present invention disposed at a construction site.
Figure 2:
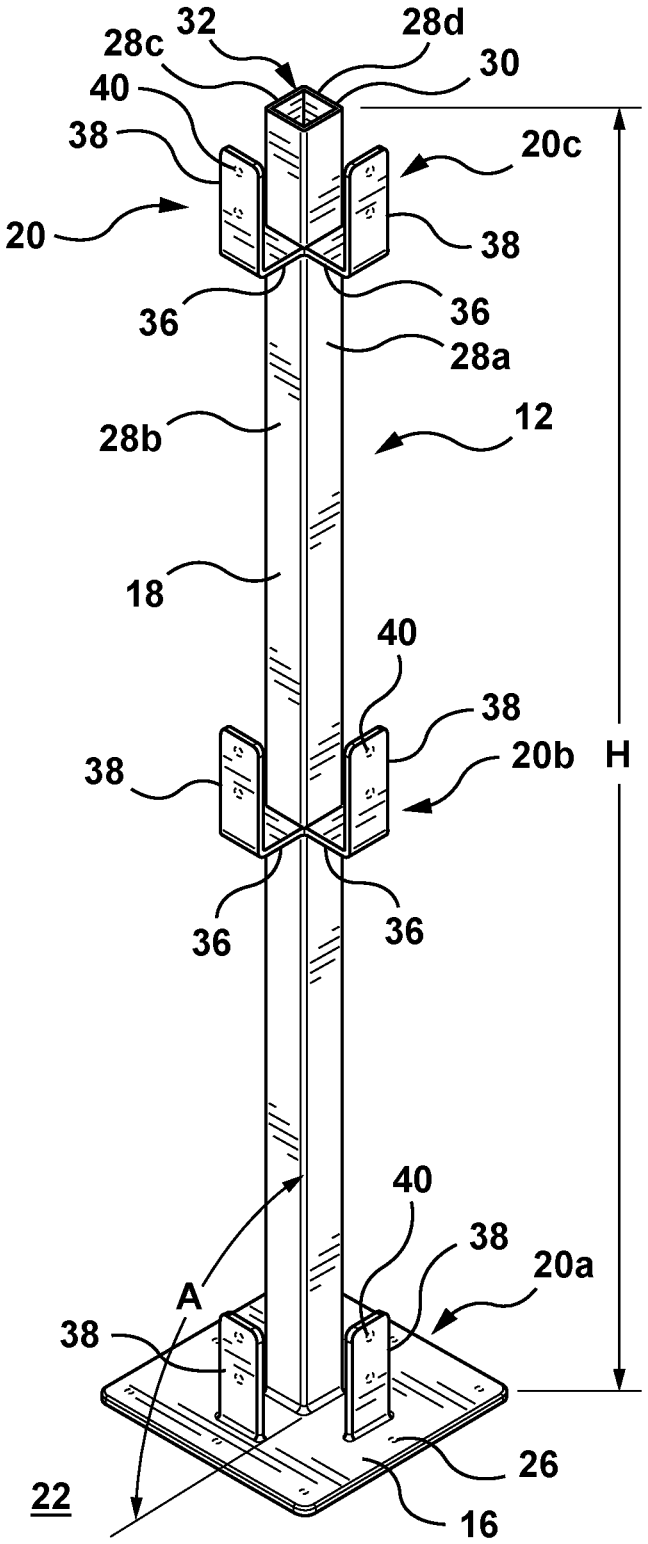
FIG. 2 is a top perspective view of a post for a guard rail system in accordance with one aspect of the present invention.

A guard rail system in accordance with the present invention is shown generally at 10 FIG. 1. System 10 includes posts 12 and rails 14. System 10 may be temporarily installed at a construction site to provide guard rails where desired or as required by local building codes. System 10 may then be removed, stored and transported for reuse at another construction site in future. Posts 12 are described in more detail below. Rails 14 are typically formed from lengths of 2×4 lumber that may be locally sourced and require no further modifications. Alternatively, rails 14 may be formed of other suitable materials, such as lengths of metal or plastic provided that the materials meet the applicable local building codes.

Posts 12 each include a base 16, body 18 and a plurality of rail supports 20. Posts 12 are preferably formed of powder coated steel.

Base 16 is adapted to be secured to a surface 22 using fasteners (not shown) extending through holes 26 defined in base 16. Fasteners may be screws, bolts or other suitable fasteners that extend through holes 26. Fasteners could alternatively comprise clamps or the like that engage base 16 without the need to use holes 26.

Body 18 extends from base 16 to a desired height H. Body 18 extends at an angle A from base 16 that in most instances is 90 degrees. Angle A could be less than 90 degrees however for use in securing base 16 to an inclined surface such as a ramp or roof line (not shown). Base 16 and body 18 may be permanently secured together with welds or may be removably and/or adjustably attached through the use of bolts or other attachment mechanisms (not shown).

Body 18 may be of tubular construction as shown in FIGS. 1-5. Most preferably, body 18 may be a hollow tube with a square cross section and a plurality of outer faces 28*a-d*. Body 18 may further include a top portion 30 defining a stacking opening 32 for receiving a stacking fin 34 as described further below.

Rail supports 20 are disposed on posts 12 at desired locations to support rails 14. Most preferably, rail supports 20 include a toe rail support 20*a*, a mid rail support 20*b* and a top rail support 20*c*. The distance of each rail support 20 from surface 22 is determined by local building codes. In a preferred embodiment, at least for the building codes of the North American market, top rail support 20*c* is spaced 35.5 inches from base 16 and mid rail support 20*b* is spaced at the mid point between top rail support 20*c* and base 16. Preferably, rail supports 20 are disposed on adjacent orthogonal faces 28*a* and 28*b* of body 18. This allows post to support rails 14 in two directions if desired to form a 90 degree corner.

Figure 6:
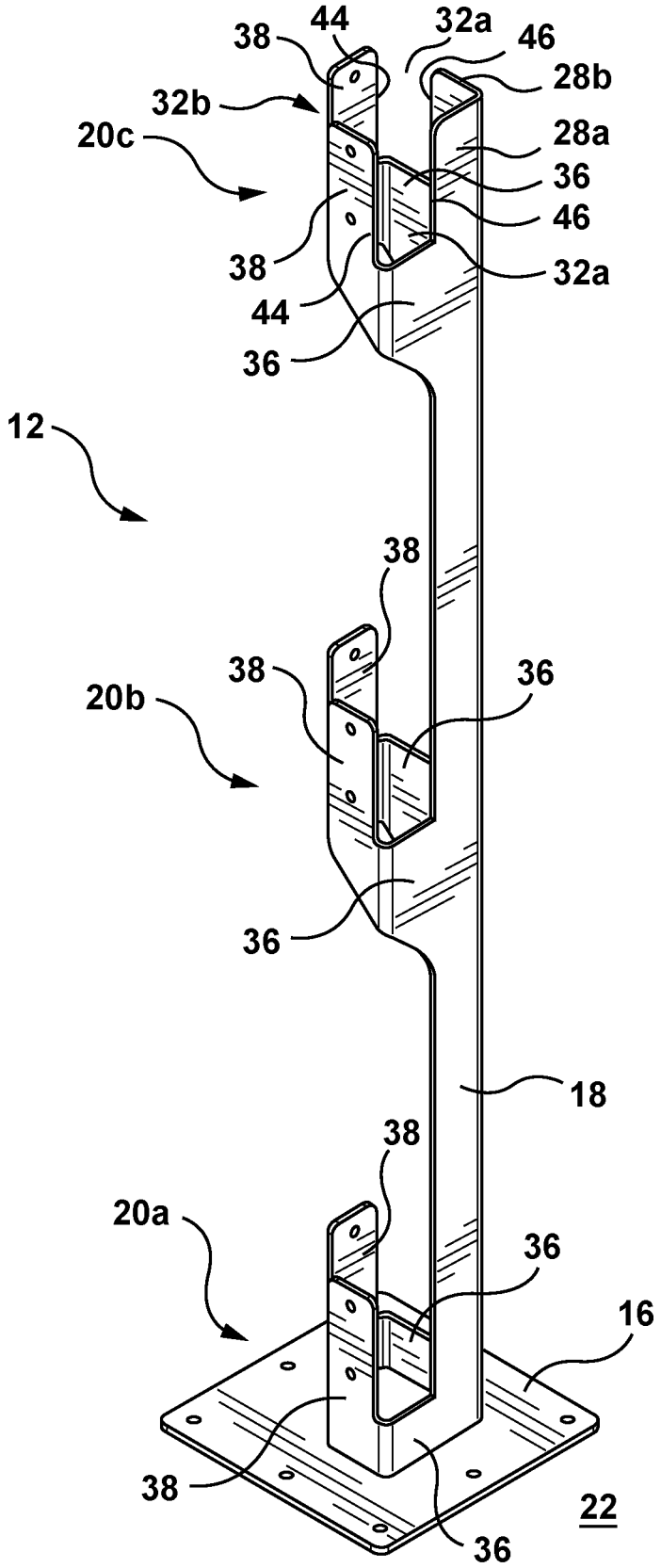
FIG. 6 is a top perspective of a post for a guard rail system in accordance with another aspect of the present invention.
Figure 7:
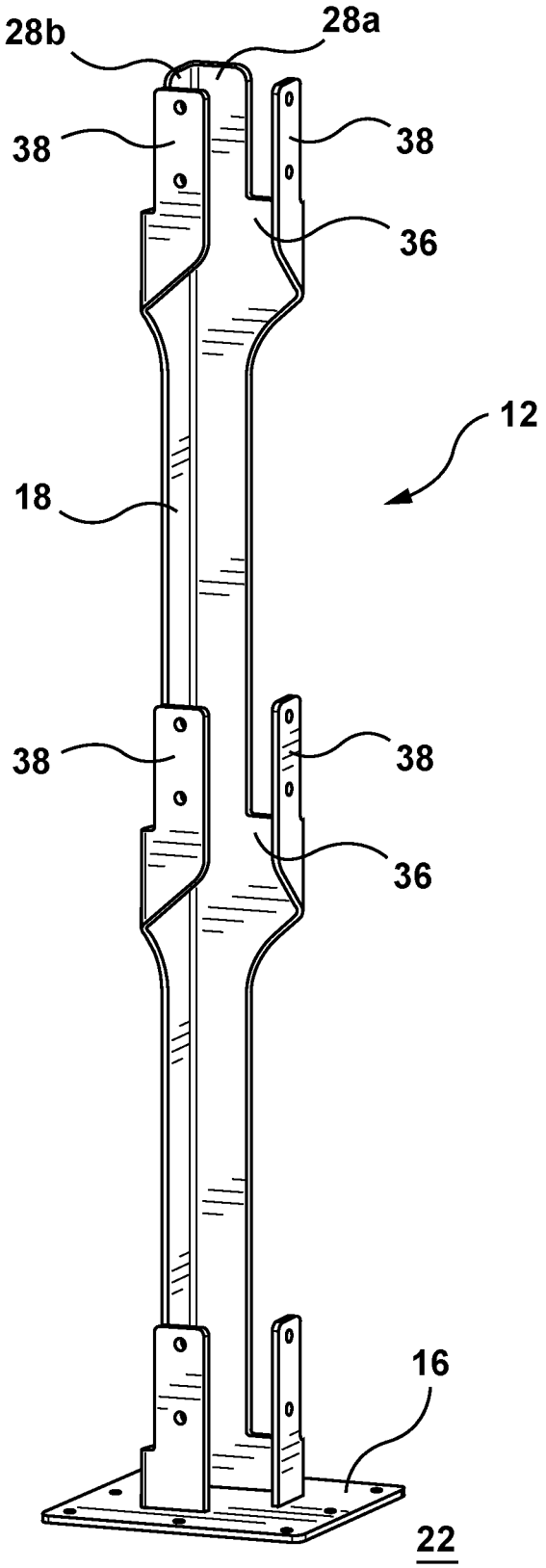
FIG. 7 is a top perspective view from a different angle of the post of FIG. 6.

Mid rail support 20*b* and top rail support 20*c* may each include a base portion 36, extending from body 18 parallel to base 16, and a side portion 38, extending upwardly from base portion 36 parallel to body 18. Toe rail portion 20*a* may simply include a side portion 38 extending upwardly from base 16 (as shown for example in FIG. 2) or may include a base portion 36, extending from body 18 parallel to base 16, and a side portion 38, extending upwardly from base portion 36 parallel to body 18 (as shown for example with a different embodiment in FIG. 6). Side portion 38 of rail supports is spaced sufficiently from body 18 to allow a single rail 14 to be seated between body 18 and side portion 38. Holes 40 are defined in side portion 38 of rail support 20 for receiving fasteners to secure rails 14 to rail supports 20.

Figure 3:
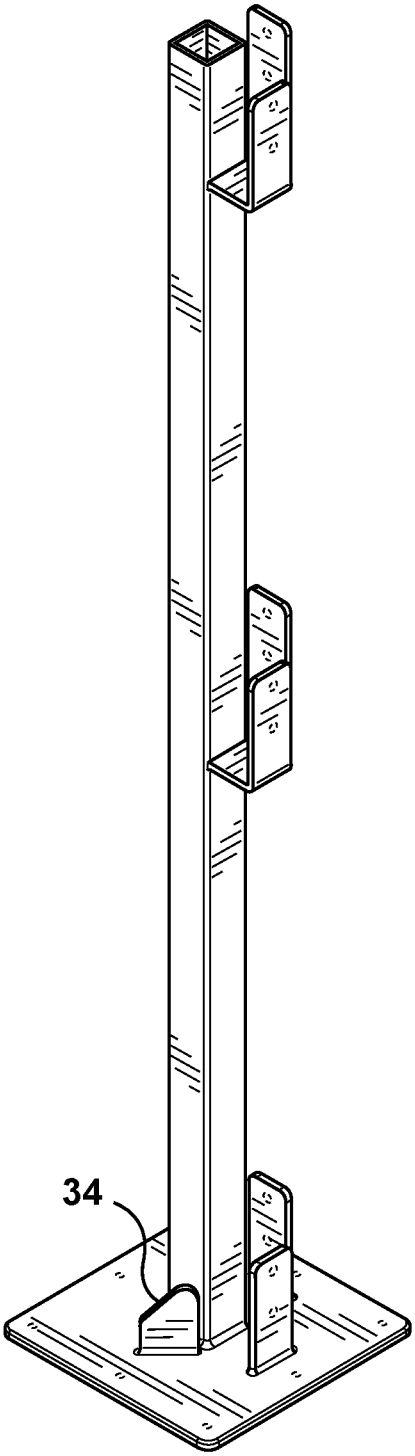
FIG. 3 is a bottom perspective view of the post of FIG. 2.
Figure 4:
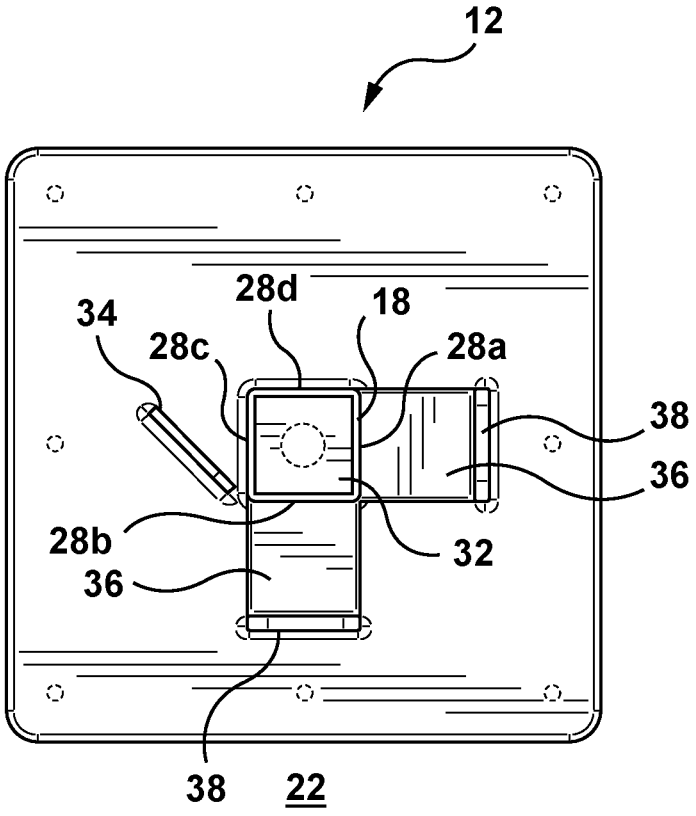
FIG. 4 is a top view of the post of FIG. 2.
Figure 5:
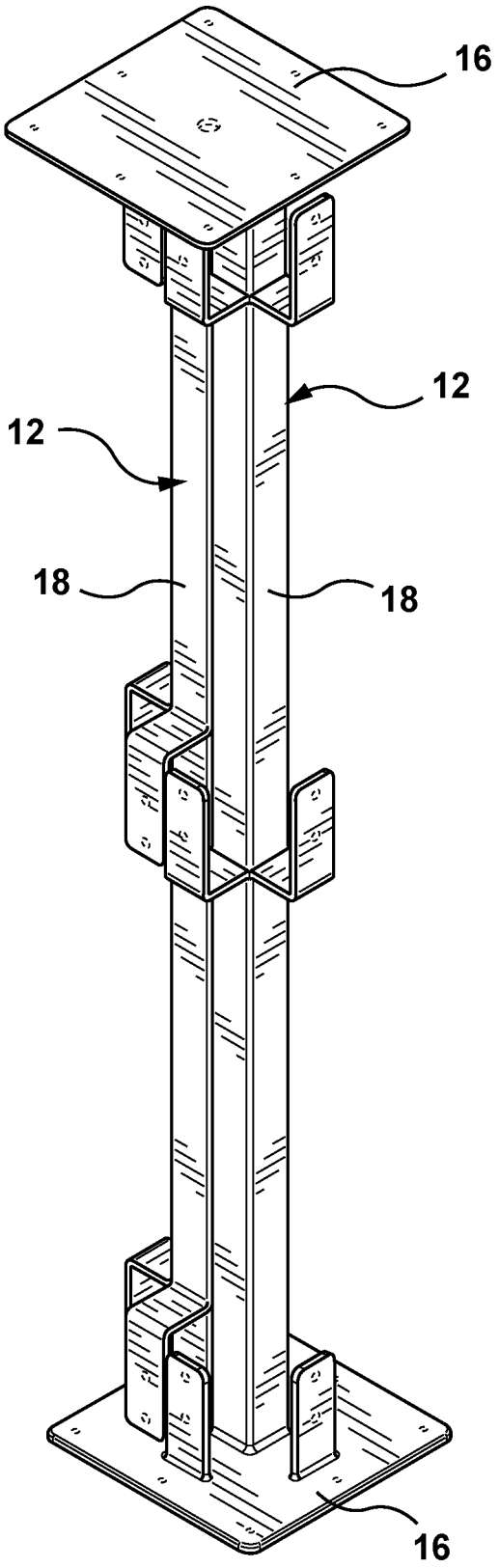
FIG. 5 is a top perspective view of the post of FIG. 2 with a second identical post stacked in an upside-down orientation thereon.

Referring to FIGS. 3-5, stacking fin 34 extends upwardly from base 16 parallel to body 18. Stacking fin 34 is sized to fit within stacking opening 32 of top portion 30 of a second post 12 that is stacked in an upside down orientation (as shown in FIG. 5). As a result, stacking fins 34 of the adjacent posts 12 fit within the corresponding stacking openings 32 to securely stack the posts 12 together for storage and transportation. Preferably, stacking fin 34 is disposed at a 45 degree angle relative to one of faces 28*c* or 28*d* of body 18 that oppose one of faces 28*a* or 28*b* where rail supports 20 are attached. Preferably, stacking fin 34 is sized to fit diagonally within stacking openings 32. In this configuration, it is possible to stack numerous posts 12 closely together to fit on a pallet for storage or transportation.

Referring to FIGS. 6-9, another embodiment for post 12 is shown. Similar reference numerals are used to refer to similar elements for the embodiments described herein.

Post 12 includes base 16, body 18 and rail supports 20. In this embodiment however body 18 and rail supports 20 are preferably integrally formed from a single piece of material. Rail supports 20 include a toe rail support 20*a*, a mid rail support 20*b* and a top rail support 20*c*. Rail supports 20 each include a base portion 36 and a side portion 38.

Body 18 is preferably formed with two orthogonal faces 28*a* and 28*b*. Base portions 36 of each rail support extend in the same plane as the respective faces 28*a*, 28*b* of body 18. Side portions 38 of each rail support extend orthogonally to the respective base portions 36. As a result, side portion 38 extending from face 28*a* is disposed parallel to face 28*b* and side portion 38 extending from face 28*b* is disposed parallel to face 28*a*.

Figure 8:
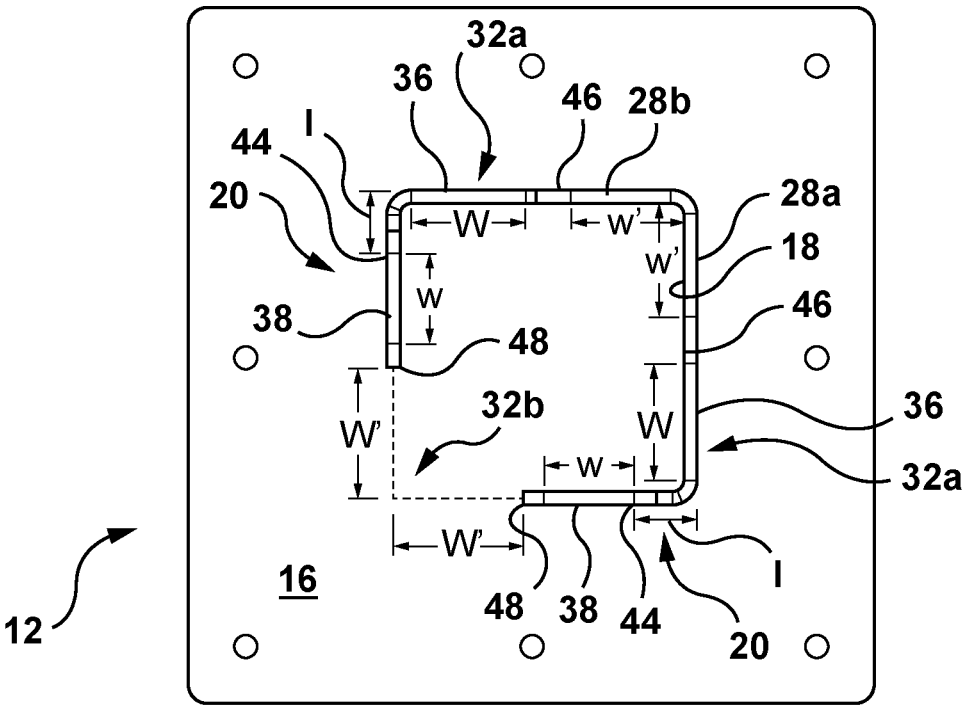
FIG. 8 is a top view of the post of FIG. 6.
Figure 9:
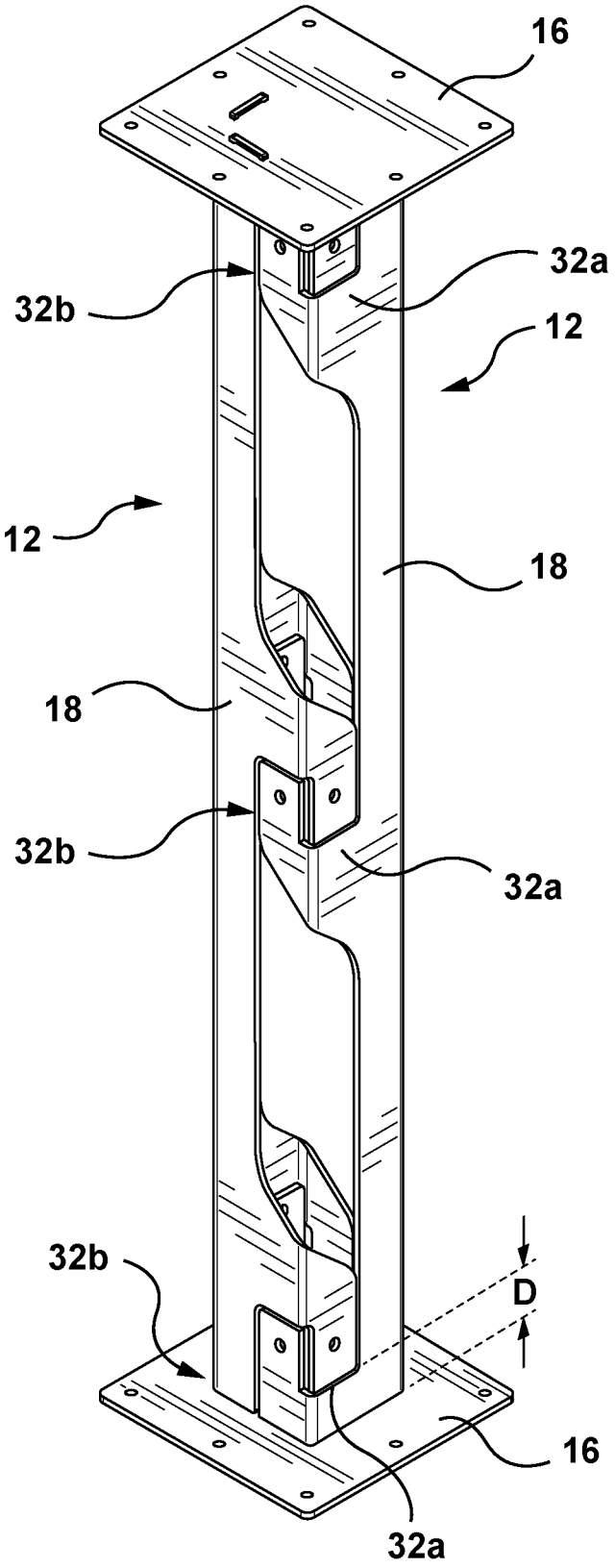
FIG. 9 is a top perspective view of the post of FIG. 6 with a second identical post stacked in an upside-down orientation thereon.

Body 18 further includes a plurality of first stacking openings 32*a* and second stacking openings 32*b* that allows two posts 12 to be stacked together in a reverse (upside down) orientation (as shown in FIG. 9). First stacking openings 32*a* are defined between the adjacent edges 44 of side portions 38 and the edges 46 of their respective faces 28*a* and 28*b*. As shown in FIG. 8, first stacking openings 32*a* have a width W that is wider than the width w of respective side portions 38 to allow side portions 38 to slidably fit within first stacking openings 32*a* when two posts 12 are being reverse stacked. Side portions 38 are also inset a distance I from the plane of the respective orthogonal faces 28*a* and 28 *b* to allow side portions to slide along the inside face of the respective base portions 36 a desired distance D to achieve a locking orientation as shown in FIG. 9. Second stacking openings 32*b* are defined between the adjacent edges 48 of each adjacent pair of side portions 38. Second stacking openings 32*b* define an imaginary right angle with sides having a width W' that are wider than the width w' of each respective orthogonal face 28*a* and 28*b* to allow the orthogonal faces 28*a* and 28*b* of a second post 12 to slidably fit within second stackable openings 32*b* when two posts 12 are being reverse stacked. In this configuration, it is possible to stack numerous posts 12 closely together to fit on a pallet for storage or transportation.

Figure 10:
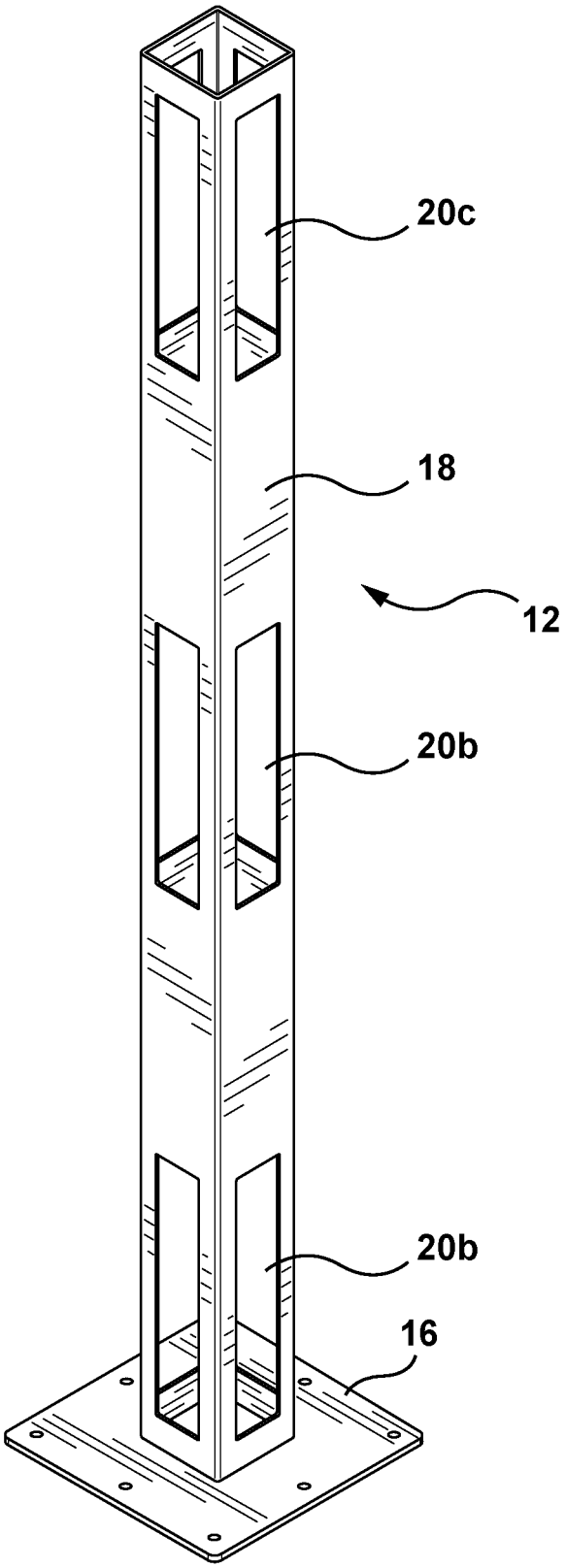
FIG. 10 is a top perspective of a post for a guard rail system in accordance with another aspect of the present invention.

Referring to FIG. 10, another embodiment for post 12 is shown. Similar reference numerals are used to refer to similar elements for the embodiments described herein.

Post 12 includes base 16, body 18 and rail supports 20. In this embodiment however rail supports 20 are defined through body 18 on all four faces 28*a-d*.

While the above description provides examples of one or more processes or apparatuses, it will be appreciated that other processes or apparatuses may be within the scope of the accompanying claims.

We claim:

1. A guard rail system, said system comprising at least one pair of posts, each of said posts comprising:

a base, for securing to a surface;

a body extending from said base;

a plurality of rail supports extending from said body, said rail supports being adapted for supporting rails between said at least one pair of posts;

a stacking opening defined in said body; and a stacking fin disposed on said post, said stacking fin being sized to fit within said stacking opening of another one of said posts;

wherein said at least one pair of posts is releasably stacked for storage or transport with one of said at least one pair of posts disposed in an upside down orientation relative to the other of said at least one pair of posts and with the stacking fin of each post disposed within the stacking opening of the other post.

2. A guard rail system as claimed in claim 1 wherein, for each of said posts, said stacking fin is disposed on said base.

3. A guard rail system as claimed in claim 1 wherein, for each of said posts, said stacking opening is defined at a top portion of said body.

4. A guard rail system as claimed in claim 1, wherein said body of each of said at least one pair of posts comprises at least two orthogonal faces.

5. A guard rail system as claimed in claim 4, wherein said plurality of rail supports of each of said at least one pair of posts extend from two of said at least two orthogonal faces.

6. A guard rail system as claimed in claim 5, wherein said plurality of rail supports of each of said at least one pair of posts each includes a base portion, extending parallel to said base from a corresponding one of said at least two orthogonal faces of said body, and a side portion extending upwardly from said base portion parallel to said corresponding one of said at least two orthogonal faces of said body from which said base portion extends.

7. A guard rail system as claimed in claim 1, wherein, for each of said posts, said plurality of rail supports include a top rail support located at a top portion of said body and a mid rail support located between said top portion of said body and said base.

8. A guard rail system as claimed in claim 7, wherein, for each of said posts, said plurality of rail supports further include a toe rail support located proximate to said base, said mid rail support being located between said toe rail support and said top rail support.

9. A guard rail system as claimed in claim 8, wherein, for each of said posts, said base forms the base portion of said toe rail support.

10. A guard rail system as claimed in claim 8, wherein, for each of said posts, said toe rail support comprises a side portion extending upwardly from said base portion.

11. A guard rail system as claimed in claim 1, wherein, for each of said posts, said body and plurality of said rail supports are integrally formed from a single piece of material.

12. A guard rail system as claimed in claim 1, wherein said stacking fin is sized to fit diagonally in said stacking opening of said corresponding second post.

13. A guard rail system as claimed in claim 1, wherein each of said posts comprises power coated steel.

14. A guard rail system as claimed in claim 1, wherein, for each of said posts, said base comprises holes through which one or more fasteners are extended for securing to the surface.

15. A guard rail system as claimed in claim 1, wherein, for each of said posts, the base and the body are removeably attached to each other.

16. A guard rail system as claimed in claim 1, wherein, for each of said posts, the base and the body are adjustably attached to each other.

17. A guard rail system as claimed in claim 1, wherein, for each of said posts, the body is a hollow tube with a square cross section.

18. A guard rail system as claimed in claim 1, wherein, for each of said posts, said stacking fin is disposed at a 45 degree angle relative to a face of the post.

19. A guard rail system as claimed in claim 1, wherein, for each of said plurality of rail supports, said rail support comprises a hole through which a fasteners is extended for securing to a rail to the rail support.

20. A guard rail system as claimed in claim 1, wherein, for each of said posts, the base and the body are welded to each other.

* * * * *